United States Patent [19]

Wallbaum

[11] 4,084,559

[45] Apr. 18, 1978

[54] SPEED CONTROL APPARATUS FOR AN INTERNAL COMBUSTION ENGINE

[75] Inventor: Hellmut Wallbaum, Wolfsburg, Germany

[73] Assignee: Volkswagenwerk Aktiengesellschaft, Germany

[21] Appl. No.: 732,458

[22] Filed: Oct. 14, 1976

[30] Foreign Application Priority Data

Oct. 15, 1975 Germany ..... 2546076

[51] Int. Cl.[2] ..... F02D 11/10

[52] U.S. Cl. ..... 123/102; 123/108; 123/179 G; 180/105 E

[58] Field of Search ..... 123/102, 108, 179 G, 123/179 B, 179 BG; 180/105 E

[56] References Cited

U.S. PATENT DOCUMENTS

| | | | |
|---|---|---|---|
| 2,883,975 | 4/1959 | Spetner | 180/105 E |
| 2,989,644 | 6/1961 | Schultz | 123/179 B |
| 3,249,175 | 5/1966 | Baxter | 123/102 |
| 3,809,034 | 5/1974 | Durichen | 123/102 |
| 3,948,240 | 4/1976 | Hirosawa et al. | 123/179 G |

FOREIGN PATENT DOCUMENTS

| | | | |
|---|---|---|---|
| 1,954,843 | 3/1971 | Germany | 180/105 E |

*Primary Examiner*—Charles J. Myhre
*Assistant Examiner*—Craig R. Feinberg
*Attorney, Agent, or Firm*—Brumbaugh, Graves, Donohue & Raymond

[57] ABSTRACT

Speed control apparatus for an internal combustion engine comprises a throttle valve in an intake pipe of the engine, a throttle adjusting element for actuating the throttle valve, and a speed control regulator connected to the throttle adjusting element. The regulator produces a signal representative of the difference between the actual value and a desired value of engine speed and the throttle adjusting element actuates the throttle valve in dependence upon this signal when the engine is not idling. Means are provided for moving the throttle valve into its idling position when the voltage supplied to the speed control regulator is interrupted. In accordance with the invention (1) the throttle adjusting element is permanently mechanically coupled to the throttle valve; (2) switch means are provided which automatically interrupt the voltage supplied to the speed control regulator when the engine speed falls below a minimum value that lies below idling speed; and (3) a starting pulse switch is connected in parallel with the above-mentioned switch for supplying a voltage pulse to the speed control regulator determinative of the starting position of the throttle valve.

6 Claims, 2 Drawing Figures

SPEED CONTROL APPARATUS FOR AN INTERNAL COMBUSTION ENGINE

BACKGROUND OF THE INVENTION

The present invention concerns an arrangement for an internal combustion engine comprising a throttle valve in an intake pipe of the engine and a speed control regulator connected to the throttle valve. The regulator includes an actual value and a desired value signal generator as well as a throttle adjusting element, controlled as a function of the difference between actual and desired values, connected to actuate the throttle valve during non-idling operation of the engine. Means are provided for moving the throttle valve into its idling position when the supply voltage to the regulator is disconnected.

An arrangement of above-described type, whereby the throttle adjusting element is connected with the throttle valve only during non-idling operation of the engine, is disclosed in the West German Pat. No. 2,120,510. In this case an electromagnetic coupling is provided between the shaft of an adjusting motor which constitutes the throttle adjusting element, on the one hand, and the throttle valve spindle, on the other. The electromagnetic coupling is actuated by an exciter circuit having a thermal switch which closes the circuit only when the internal combustion engine reaches a given minimum temperature. A return spring acting on the throttle valve spindle serves to move the throttle valve into its idling position when the voltage supply to the speed control regulator is disconnected for any reason. This return spring also maintains the throttle valve in its idling position whenever the aforementioned electromagnetic coupling is not excited. Thus, when the engine is started, the speed control regulator operates—i.e., produces a control signal—but this signal is not transmitted to the throttle valve due to the non-excited state of the electromagnetic coupling.

Accordingly, an advantage of this known arrangement is that, in case of failure of the supply voltage of the speed control regulator, the throttle valve is moved into its idling position and not to a position in which the engine speed assumes undesirably high values. On the other hand, this known arrangement has the disadvantages that () the adjusting motor operates continuously prior to attainment of the prescribed engine temperature and (2) the other control devices of the internal combustion engine, such as mechanisms for ease of starting, must act directly on the throttle valve spindle. This latter condition leads to complex arrangements which are subject to the effects of inertia. Moreover, the moment at which the speed control regulator commences to control the throttle valve is not precisely determined in the prior art system because it is ultimately dependent upon the time at which the thermal switch closes in the exciter circuit of the electromagnetic coupling.

It is a principal object of the present invention to provide apparatus of the above-described type which avoids these various disadvantages.

SUMMARY OF THE INVENTION

The above object, as well as other objects which will become apparent in the discussion that follows, are achieved, according to the present invention by (1) permanently connecting the throttle adjusting element to the throttle valve, (2) providing a switch in the engine voltage supply system which automatically opens and interrupts the voltage supplied to the speed control regulator when the engine speed falls below a minimum value below the idling speed, and (3) connecting a starting pulse switch in parallel with the switch for supplying a voltage pulse to the speed control regulator determinative of the starting position of the throttle valve.

Accordingly, a first essential characteristic of the invention may be found in the fact that the throttle adjusting element—which is preferably a lifting magnet—is in permanent connection with the throttle valve. This arrangement makes possible the operation of the throttle valve spindle, by means of the throttle adjusting element, in response to commands which are not obtained by a comparison of the actual and desired values of speed. As a result, the disadvantageous connection of additional force transmission elements directly to the throttle valve spindle may be avoided.

In accordance with a second essential characteristic of the invention, the cut-off switch provided in the voltage supply system of the engine, which is open below a minimum speed (preferably the cutting-in speed of a generator regulator), keeps the speed control regulator cut off until such minimum speed is attained. In this way, due to the design of the throttle adjusting element, the throttle valve is held in the idling position when the voltage applied to the speed control regulator is interrupted. In accordance with a third essential characteristic of the invention, since a different (non-idling) position of the throttle valve—and, if present, of an additional air inlet or choke valve in the intake pipe—may be more suitable during starting of the engine, a starting pulse switch is arranged in parallel with the cut-off switch for controlling the starting positions of the throttle valve and choke (if any). If, as in a preferred embodiment of the present invention, an additional switch is provided in series with the aforementioned cut-out switch, thereby facilitating manual control by the engine operator, the starting pulse switch should be arranged in parallel with the series connection of these two switches. Although the starting pulse switch may be actuated manually, it is more suitable to provide for automatic actuation in conjunction with the operation of the starting and/or ignition switch of the engine so that the optimal starting position of the throttle valve and a fuel pilot injection may be attained.

If the internal combustion engine is equipped in the intake pipe with a choke valve provided with automatic choke control it may be advisable, in the interest of attaining the most favorable starting position of the throttle valve and choke, to insert in the line supplying voltage to the automatic choke control a switch which opens below the minimum speed; i.e., again below the cut-in speed of the generator regulator. With this arrangement, the opening process of the automatic choke will commence during run-up of the engine and not when the ignition switch is turned on.

The system design whereby one and the same throttle adjusting element may be used for transmission of various commands to the throttle valve by way of the speed control regulator and whereby the throttle adjusting element is operative, upon removal of the voltage supplied to the speed control regulator, to swivel the throttle valve into its idling position, offers advantage, in cases where an engine ignition switch is arranged in the voltage supply system, that the engine slows down with its throttle valve in the idling position when the ignition switch is turned off. It is therefore possible to completely cut off of the fuel supply to the engine by providing a small shut-off valve in the idling system; for example, on an idling jet. Moreover, it becomes an easy matter to provide means for optionally switching between the idling speed and the desired set speed of the engine. This may be accomplished in the control system by means of a selecting switch capable of disconnecting the regulator and thereby switching the engine to operation at idling speed.

For a better understanding of the invention, together with other and further objects, reference is made to the following description, taken in conjunction with the accompanying drawings, and its scope will be pointed out in the appended claims.

DESCRIPTION OF THE PREFERRED EMBODIMENT

Figure 1:
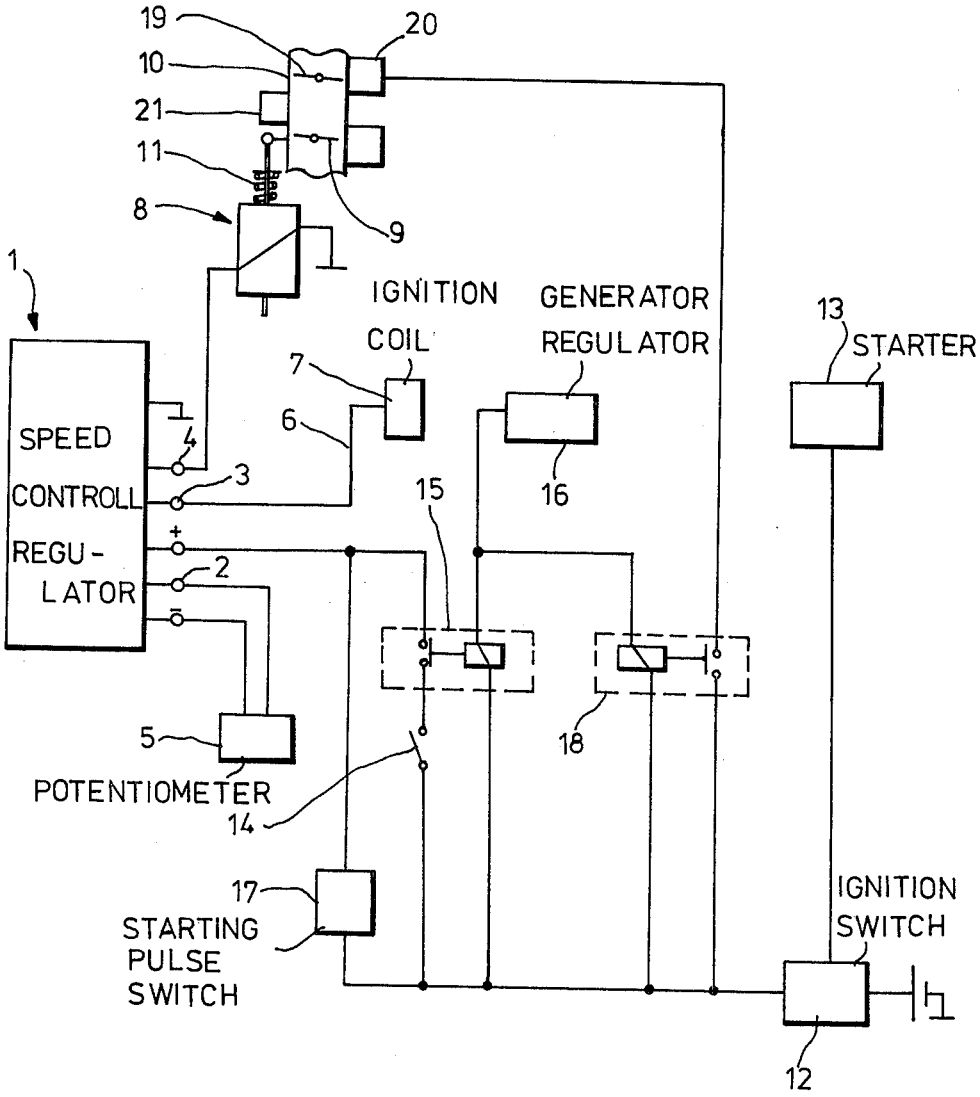
FIG. 1 is a circuit diagram of the speed control apparatus according to a preferred embodiment of the present invention.

FIG. 1 shows an electronic speed control regulator 1 comprising means for generating signals representative of the actual value and the desired value of the engine speed. The desired value signal generator is provided with an adjustable potentiometer 5. Both signal generators deliver voltages which are fed to the two inputs of a differential amplifier. The output signal thereof, corresponding to the deviation or difference between the two signals, is supplied to a throttle adjusting element 8 which is preferably an armature-lifting electromagnet. The throttle adjusting element swivels the throttle valve and the choke, if present, into a position corresponding to the instantaneous difference between the actual and desired values of speed.

In addition to the terminals marked by their polarities, which serve to receive the supply voltage, the speed control regulator 1 is provided with terminals 2, 3 and 4. Terminal 2 is the input terminal for supplying desired value signals to the aforementioned differential amplifier. These signals are produced as voltages prescribed by the potentiometer 5. To the positive terminal is connected a selector switch 14 which makes it possible, at the option of the engine operator, (1) to cause the speed control regulator to operate in accordance with the desired value voltages set by the potentiometer 5 and delivered to the input of the differential amplifier, or (2) to disconnect the source of voltage and thus switch off the regulator. If the voltage supply is disconnected, the throttle valve is automatically moved to its idling position.

To the terminal 3 is connected a line 6 delivering signals corresponding to the ignition pulses. The line 6 may originate, for example, from the region of the ignition coil 7. These signals are delivered to the actual value signal generator within the speed control regulator 1.

To the terminal 4 is connected an armature-lifting magnet 8, which serves as the throttle adjusting element in this exemplary embodiment. The push-rod mechanism 11 of the magnet is provided with a return spring and is designed in such a manner that whenever the voltage supply to the speed control regulator 1 is interrupted, thus disconnecting the voltage to the magnet 8, it swivels the throttle valve 9 in the intake pipe 10 of the engine into its idling position. Considering again the selector switch 14, this arrangement permits the selector switch to optionally select between control of the engine in accordance with the prescribed desired speed, and operation of the engine at its idling speed.

The system for supplying a voltage to the speed control regulator 1 comprises a conventional ignition and starting switch 12 which is connected to both a battery and a conventional starter mechanism 13. The previously mentioned manually operable selector switch 14 and a magnetically actuated relay switch 15 are connected in series with the ignition switch 12 and to the speed control regulator 1. The relay switch 15 is connected to the generator regulator or "cut-out" of the generator 16 of the engine. It is designed in such a manner that it closes only when the generator operates; i.e., when the speed of the engine exceeds the speed at which the generator regulator connects the generator to the battery. Until the relay switch 15 is closed, the electronic speed control regulator 1 is thus normally not effective to control the speed of the engine.

However, because the throttle adjusting element 8 is permanently mechanically coupled to the throttle valve 9 and since, further, the adjusting element is designed in accordance with the invention to maintain the throttle valve in its idling position when it receives no current, it is possible to employ this element to change the position of the throttle valve to one favorable for starting. Such control may be accomplished by reactuating the switches 14 and 15, or by providing a separate starting pulse switch 17 connected in parallel to the series connection of the switches 14 and 15. This starting pulse switch is operable, preferably automatically, at the start of operation of the ignition switch or the starter, to deliver a voltage pulse to the electronic speed control regulator 1 which results in setting the throttle valve 9 at the swivel position most appropriate for starting the engine. In detail, this voltage pulse is used to actuate the automatic control device 20 well known in the art and for instance comprising a bimetal (not shown) which then moves the choke valve 19 into a position depending on the temperature. As is also well known at the end of the voltage pulse throttle valve 9 tends to move back into its idle speed position but is stopped by stop means (not shown) mechanically linked with the choke valve 19 and determining said swivel position of throttle valve 9 most appropriate for starting the engine.

As soon as the cut-in speed of the generator regulator has been attained, the relay switch 18 is also energized, closing the circuit for the automatic choke control 20 associated with the choke valve 19, thus commencing the choke-opening process of the automatic choke.

When the ignition switch is turned off, the throttle adjusting element 8 no longer receives current and the engine —in this example a stationary engine—runs down with the throttle valve closed. It is accordingly possible to completely cut off the fuel supply to the engine by means of the small shut-off valve 21 on the customary idler nozzle so as to provide protection against dieseling.

Figure 2:
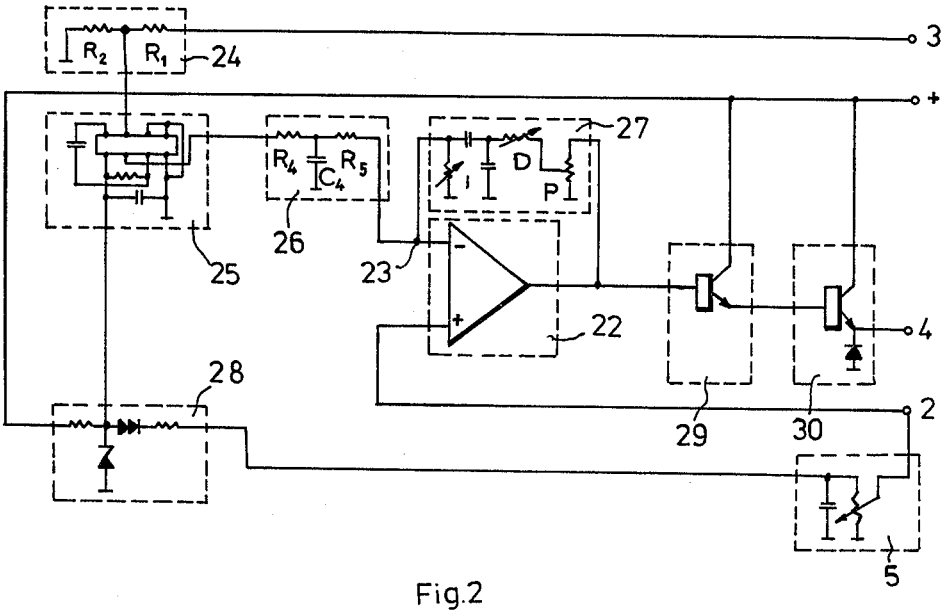
FIG. 2 is a schematic diagram of the speed control regulator employed in the apparatus of FIG. 1.

The speed control regulator 1 employed in the above-described embodiment of the invention is shown in detail in FIG. 2. This specific regulator is disclosed in the West German patent publication ("Offenlegungsschrift") No. 2,328,666 published Jan. 2, 1975. As shown in FIG. 2 the regulator comprises a differential amplifier 22 which compares an actual value speed signal applied to its input 23 with the desired value applied to the terminal 2 by the potentiometer 5.

The ignition pulses which may, for example, be obtained from the breaker points of the engine are applied through a voltage divider 24 comprising resistors $R_1$, $R_2$ to a pulse shaping circuit 25. This circuit 25 includes an integrated circuit which transforms the oscillating pulses resulting from the presence of the ignition coil in the ignition circuit into squarewave pulses of constant amplitude. The squarewave pulses are integrated by one or more R/C circuits 26 which, in the illustration, consist of the circuit elements $R_4$ and $C_4$. The voltage signal so formed, which represents the actual value of engine speed, is fed through an input resistor $R_5$ to the differential amplifier 22. Controlled feedback is provided in the known manner by means of the circuit 27.

The positive voltage derived from the voltage supply system of the engine and applied to the positive terminal of the speed control regulator is supplied through a voltage stabilization circuit 28 to the potentiometer 5. The voltage determined by the potentiometer 5 representing the desired value of speed is compared with the voltage representing the actual value and the difference voltage is passed through a driver stage 29 and a power amplifier 30 to the output terminal 4.

While there has been described what is believed to be the preferred embodiment of the invention, those skilled in the art will recognize that other and further modifications may be had thereto without departing from the spirit of the invention, and it is intended to claim all such embodiments as fall within the scope of the invention.

I claim:

1. Apparatus for controlling the speed of an internal combustion engine, said apparatus comprising, in combination:

a. a throttle valve arranged in an intake pipe of the engine;

b. a speed control regulator including means for producing signals representative of the actual value and the desired value of engine speed, and comparator means, connected to said signal producing means, for producing a signal representative of the difference between the actual and desired speed values;

c. throttle adjusting means, in constant mechanical connection with said throttle valve and connected to said speed control regulator, for actuating said throttle valve in dependence upon said difference signal during non-idling operation of the engine;

d. means, connected to said throttle valve, for moving said throttle valve into its idling position when the voltage supply to the speed control regulator is interrupted; and e. means for supplying a voltage to aid speed control regulator comprising:

(1) a voltage source;

(2) first switch means, connected between said voltage source and said speed control regulator, for interrupting the voltage supply to said speed control regulator when the engine speed is below a minimum speed, said minimum speed being below the normal idling speed of the engine; and (3) pulse switch means, connected in parallel with said first switch means, for supplying a voltage pulse to said speed control regulator determinative of the starting position of said throttle valve.

2. The apparatus defined in claim 1, wherein said voltage supplying means further comprises a generator; a generator regulator connecting said generator to said voltage source, said generator regulator being operative to disconnect said generator from said voltage source when insufficient electricity is being generated; and means, connected to said generator regulator and to said first switch means, for causing said first switch means to interrupt the voltage supply to said speed control regulator when said generator regulator is open-circuited, whereby said minimum speed is the cut-off speed of said generator regulator.

3. The apparatus defined in claim 1, wherein said voltage supplying means further comprises second switch means, connected in series with said first switch means, for interrupting the voltage supplied to said speed control regulator at the option of the engine operator, said pulse switch means being connected in parallel with the series circuit formed by said first and said second switch means.

4. The apparatus defined in claim 1, further comprising a choke valve arranged in said intake pipe of the engine; automatic choke adjusting means, connected to said choke valve, for actuating said choke valve, said choke adjusting means being operative to open said choke valve when a voltage is supplied thereto; and third switch means, connected between said voltage source and said choke adjusting means, for interrupting the voltage supply to said choke adjusting means when the engine speed is below said minimum speed.

5. The apparatus defined in claim 1, further comprising a selector switch, connected to said speed control regulator, for turning off said speed control regulator, thereby switching the engine to operation at idling speed.

6. The apparatus defined in claim 1, wherein said voltage supplying means further comprises manually-operable ignition switch means, connected between said voltage source and said speed control regulator, for simultaneously switching the voltage to said speed control regulator and the ignition system of the engine.

* * * * *